United States Patent [19]

Rosenwinkel et al.

[11] 4,295,294

[45] Oct. 20, 1981

[54] TOY LAWN MOWER

[75] Inventors: Donald A. Rosenwinkel, Tinley Park; Burton C. Meyer, Downers Grove; Harry Disko, South Barrington, all of Ill.

[73] Assignee: Marvin Glass & Associates, Chicago, Ill.

[21] Appl. No.: 139,467

[22] Filed: Apr. 11, 1980

[51] Int. Cl.[3] ..... A63H 11/10

[52] U.S. Cl. ..... 46/205; 46/39

[58] Field of Search ..... 46/39, 114, 112, 205, 46/204, 201, 202, 40, 41, 14, 111

[56] References Cited

U.S. PATENT DOCUMENTS

| | | | |
|---|---|---|---|
| 1,446,560 | 2/1923 | Greinert | 46/114 |
| 1,933,501 | 10/1933 | Allen | 46/112 |
| 1,977,457 | 10/1934 | Smith | 46/39 X |
| 2,747,328 | 5/1956 | Zalkind | 46/114 |
| 2,960,791 | 11/1960 | Reer | 46/39 |
| 3,959,922 | 6/1976 | Leistikow | 46/205 |
| 3,983,662 | 10/1976 | Hart | 46/205 |
| 4,198,068 | 4/1980 | Goldfarb et al. | 46/204 X |

*Primary Examiner*—Gene Mancene
*Assistant Examiner*—Mickey Yu
*Attorney, Agent, or Firm*—Mason, Kolehmainen, Rathburn & Wyss

[57] ABSTRACT

A toy lawn mower shaped like a conventional wheeled lawn mower and including an enclosure in the shape of a grass catcher which simulates a real grass catcher. The enclosure, which has at least one transparent side, includes a mechanism located near its bottom to agitate grass-like particles to simulate the appearance of grass blown from the mower housing into a grass catcher. The agitating a mechanism is operatively connected to a wheel axle of the toy to agitate the particles in response to movement of the toy. The toy lawn mower also has means to vibrate the lawn mower so that the grass simulating particles will collect at the bottom of the enclosure for continuous reagitation. A sounding mechanism connected to a wheel axle of the toy emits a sound similar to that of a real lawn mower when the lawn mower is pushed.

12 Claims, 4 Drawing Figures

TOY LAWN MOWER

BACKGROUND OF THE INVENTION

I. Field of the Invention

The present invention relates to a toy lawn mower and particularly to a toy lawn mower with means to simulate the flow of cut grass in a grass catcher.

II. Description of the Prior Art

Toy lawn mowers with simulated cutting means are known in the art. U.S. Pat. No. 2,960,791 issued to Reed on Nov. 22, 1960 discloses a push mower with a pair of brush-like elements 34 and 35 formed of thin sheets of flexible and resilient plastic material. The elements are rotated in response to movement of the toy. The outer portions of the elements are shredded or divided into narrow strips, strands or blades approximating the width of an ordinary blade of grass. When rotated, brush elements 34 and 35, colored grass green, simulate the ejection or discharge of cut grass from the lower periphery of the cylindrical path of the cutter bars 25. U.S. Pat. No. 3,983,662 issued to Hart on Oct. 5, 1976 discloses a push toy for picking up three-dimensional objects. The push toy includes an impeller assembly 48 which rotates around an axis in response to movement of the toy. The rotating impeller engages objects to be picked up and flips them up a ramp and into a container which may be an open top catcher simulating a grass catcher on a lawn mower.

It is an object of this invention to provide a toy lawn mower which safely simulates the appearance of a real lawn mower in the act of cutting grass.

It is still another object of this invention to provide a toy lawn mower which simulates the action of a real grass catcher on a real lawn mower.

It is still another object of this invention to provide such a toy lawn mower which is capable of continuously simulating the operation of a real grass catcher.

It is still another object of this invention to provide such a toy lawn mower which simulates the sound and feel of a real lawn mower.

SUMMARY OF THE INVENTION

The foregoing and other objects and advantages of the present invention are accomplished in the illustrated embodiment comprising a toy device having a housing in the shape of a lawn mower. At least one wheel is mounted on the housing for rotation when said housing is pushed over a surface. An enclosure in the shape of a grass catcher extends away from the housing. An agitating means is located within the enclosure and is operatively connected to the wheel. Also within the enclosure is a bed of particles held for agitation by the agitating means.

BRIEF DESCRIPTION OF THE DRAWINGS

For a better understanding of the invention, reference should be had to the following detailed description taken in conjunction with the drawings, in which.

DETAILED DESCRIPTION OF THE PREFERRED EMBODIMENT

Figure 1:
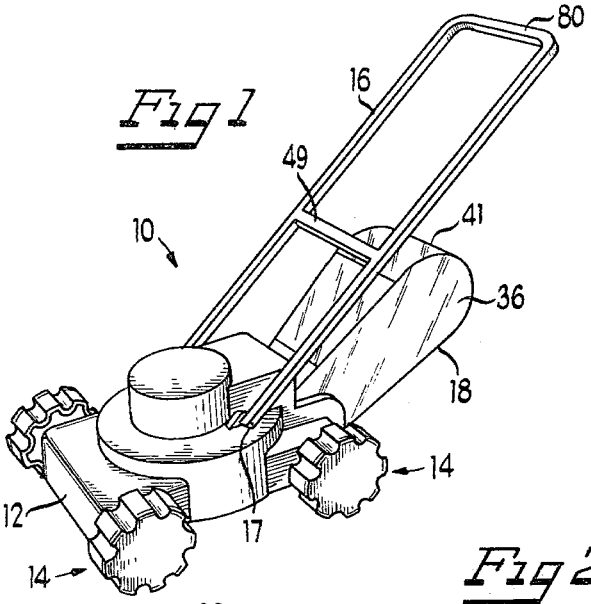
FIG. 1 is a perspective view of the toy lawn mower constructed in accordance with the features of the present invention.

Referring now more particularly to the drawings wherein like reference characters are used for like parts throughout, there is illustrated in FIG. 1 a toy lawn mower constructed in accordance with the features of the present invention and referred to generally by the reference numeral 10. The toy lawn mower 10 is fashioned in the shape of a conventional gasoline engine operated power mower, but the toy device could be made in the shape of any conventional power tool. The toy lawn mower 10 includes a lawn mower housing 12 conveniently made of molded plastic, a pair of wheel assemblies 14, a rearwardly extending handle 16 and an enclosure 18.

Figure 2:
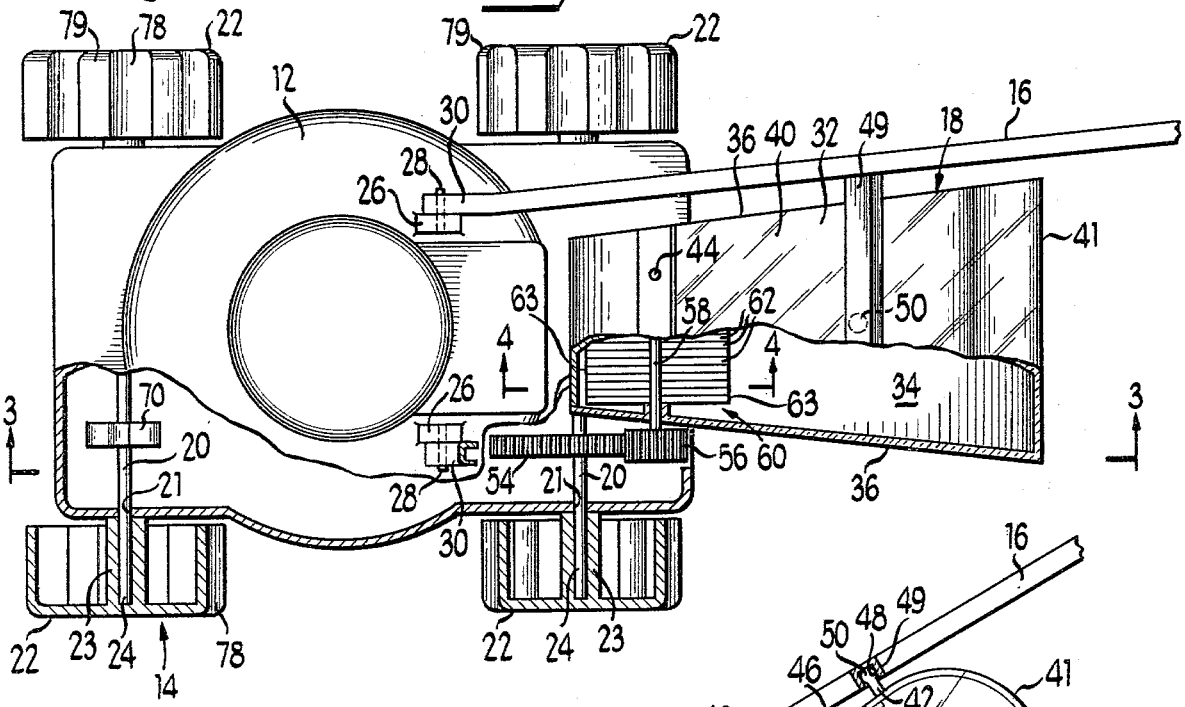
FIG. 2 is an enlarged, partially cut away, top plan view of the toy device shown in FIG. 1.

As shown in FIG. 2, each wheel assembly 14 includes an axle 20 mounted for rotation, which telescopes through openings 21 in opposed sides of housing 12 and a pair of tires 22 attached to each opposed end of each axle 20. The tires 22 each have a central internal collar 23 which is fixed to the opposed ends 24 of each axle 20 conveniently by a suitable adhesive. Since the collars 23 have a diameter larger than the openings 21, the wheel assemblies 14 are retained in housing 12.

Handle 16 attaches to the upper surface of housing 12 by means of two spaced apart mounting brackets 26. A pin 28 telescopes through an aperture in each mounting bracket 26 and through a similar aperture in the lower most end 30 of handle 16 to secure the handle to housing 12 for rotation around the pin 28. The downward rotation of the handle 16 is arrested by interference between lower handle corner 17 and the surface of housing 12 or by other means so that the handle 16 normally extends rearwardly and upwardly away from housing 12.

Figure 4:
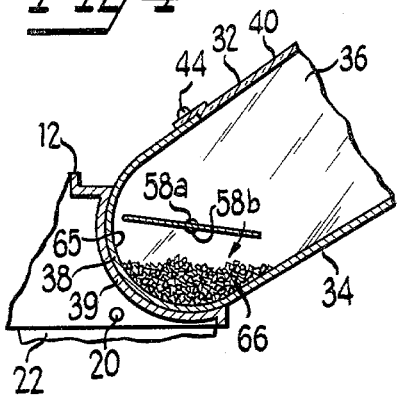
FIG. 4 is a fragmentary, cross-sectional view taken generally along line 4—4 of FIG. 2.

The enclosure 18, preferably shaped like a grass catcher, is illustrated as an elliptical solid having a trapezoidal upper side 32, a trapezoidal lower side 34, opposed lateral sides 36, rounded lower portion 38 and a wider uppermost end 41. Preferably, the upper side 32 and the opposed lateral sides 36 are transparent. As shown in FIG. 4, the rounded lower portion 38 of enclosure 18 is secured by integral molding, adhesive or other suitable means to a complementary shaped surface 39 on the rear of housing 12. The upper side 32 of enclosure 18 includes a hatch 40 and an outwardly extending snap pin 42. The hatch 40 is secured within upper side 32 by a screw 44 on one end and by an L-shaped catch 46 on the other end. The snap pin 42 preferably is releasably engageable with a resilient slot 48 in cross-bar 49 of handle 16. The resilient slot 48 is shaped to tightly conform to the enlarged head 50 of pin 42 and to frictionally engage and secure the head 50 within the slot 48. In this way, the enclosure 18 can be releasably supported near its uppermost end 41 to prevent the generation of an excessive movement around the region of attachment of portion 38 to surface 39.

Figure 3:
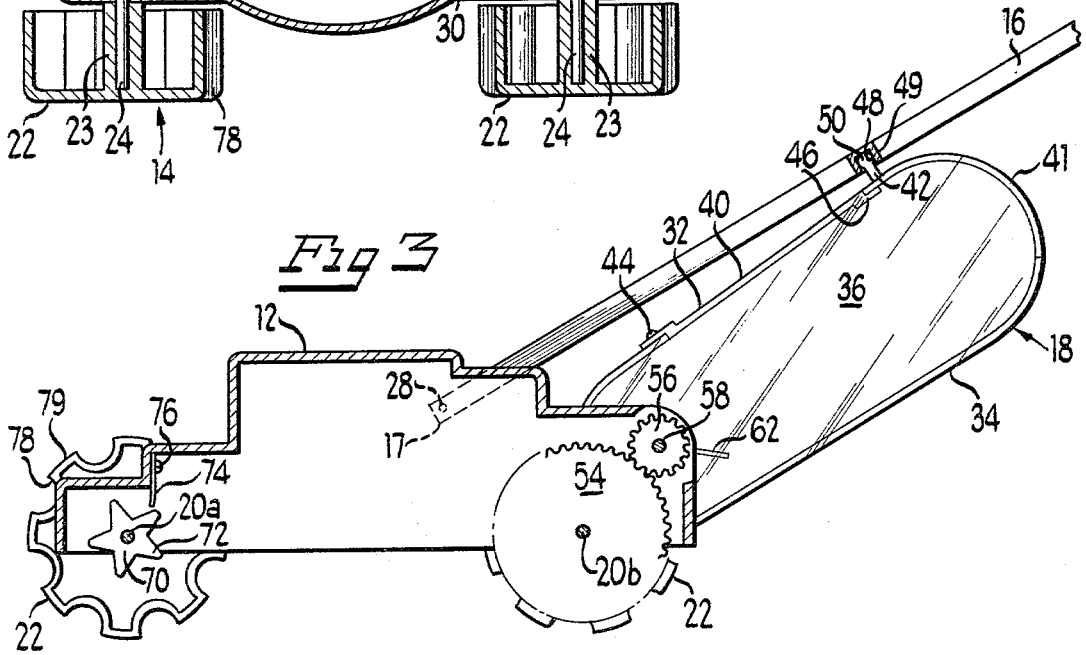
FIG. 3 is a cross-sectional view taken generally along the line 3—3 of FIG. 2.

As shown in FIG. 3, inwardly mounted on rear axle **20*b* is a gear 54 which engages a pinion 56 held on a grass catcher axle 58, supported for rotation by opposed lateral sides 36 of enclosure 18. A resilient sheet 60 is clamped conveniently by rivets or the like at its center between the halves 58*a* and 58*b* of axle 58, wholly within enclosure 18. The sheet 60 shown in FIG. 2 is rectangular and extends across enclosure 18 from one opposed lateral side 36 to the other. The portion of the sheet 60 extending outwardly from between axle halves 58***a* and 58*b* is slit along parallel spaced radial lines to form a plurality of side-by-side strips 62. The free ends 63 of strips 62 are spaced slightly from the inside surface 65 of rounded lower portion 38 which generally conforms to the path of rotation of free ends 63. The sheet 60 is conveniently made of a tough plastic film, such as polypropylene, of sufficient stiffness to cause sheet 60 to extend straight outwardly from axle 58. As shown in FIG. 4, a bed of comminuted particles 66 is contained within rounded lower portion 38 of enclosure 18. The comminuted particles 66 may conveniently be cut up Mylar film particles which are colored green for added realism.

A sounding means or noise maker gear 70 is mounted centrally on forward axle 20*a* within housing 12, inwardly of the tires 22. The noise maker gear 70 includes a plurality of radially extending arms or spurs 72. A vibratable reed 74 is mounted on housing 12 conveniently by a threaded attachment means 76 so as to depend between adjacent arms 72 of noise maker gear 70. The vibratable reed 74 may be a strip of blue spring steel.

The outer surfaces of tires 22 have a plurality of equally spaced circumferentially arranged depressions 78 between raised lands 79. The depressions 78 are sized to cause vibrations as the tires 22 rotate due to the impact of successive lands 79 against the surface over which the toy is pushed. As shown in FIG. 3, the depressions 78 have a length approximately equal to that of lands 79.

The toy lawn mower operates as follows. A child stands behind the toy 10 and grasps the cross-member 80 of handle 16 and pushes forwardly. This causes the tires 22 and their associated axle 20 to rotate. As front axle 20*a* rotates, noise making gear 70 engages vibratable reed 74 causing the reed to make a sound which simulates the sound of a lawn mower. Preferably, the reed 74 is capable of simulating the plunking sound of a small gasoline engine. At the same time, rear axle 20*b* is caused to rotate driving pinion 56 in the opposite direction, in turn rotating axle 58 and resilient sheet 60, as indicated by the arrow in FIG. 4. As the resilient sheet 60 rotates, it collects some of the comminuted particles 66 on the downward portion of its rotation cycle and moves them upwardly along the inside surface 65 of lower portion 38. When the resilient sheet 60 approaches the upper side 32 of the enclosure 18, the comminuted particles 66 are flung rearwardly away from housing 12 into the central region of enclosure 18 by centrifugal force. The comminuted particles 66 are dispersed throughout the interior of enclosure 18 for a while, but eventually settle upon the inside surface of lower side 34. The rearwardly propelled particles closely simulate the appearance of cut blades of grass blown from a lawn mower.

Although the lower side 34 is generally inclined downwardly toward lower portion 38, the movement of the comminuted particles 66 back into lower portion 38 is further aided by the vibrations generated by tires 22. Specifically, the depressions 78 in the tires 22 create vibrations which are transmitted to enclosure 18 tending to move the particles down the lower side 34 into rounded lower portion 38. In this way, a supply of particles 66 is always positioned in lower portion 38 for agitation by sheet 60. In addition, the vibrations developed by the tires 22 as they rotate is communicated to housing 12 and handle 16 thereby simulating the vibration of a real lawn mower.

Although the present invention has been described with reference to a single illustrated embodiment, it should be understood that numerous other modifications and embodiments can be devised by those skilled in the art that will fall within the spirit and scope of the principles of this invention. For example, the power tool disclosed could be easily modified to represent a snow blower, leaf sweeper, thatcher, power sander, power saw, power drill, power rake, plow or any other type of power tool where some type of ramentary element or waste is discharged. The invention presents a realistic looking device, where, unlike the prior art, the simulated waste, or particulate matter, is contained in an enclosed, transparent housing so as to be clean and convenient in use.

What is claimed as new and desired to be secured by Letters Patent of the United States is:

1. A toy power tool comprising:

a housing in the shape of a power tool;

wheel means mounted on said housing for rotation when said housing is pushed over a surface; and, enclosure means extending away from said housing for holding particulate matter, said enclosure means including a bed of particulate matter and agitating means mounted within said enclosure means for creating a cloud-like particulate suspension of said matter in air, said agitating means including a rotatable brush mounted adjacent one end of said enclosure means, a lower end of said enclosure means conforming to the path of movement of said agitating means so that said particulate matter is contacted by said agitating means and dispersed within the interior of said enclosure means when said toy is pushed over a surface, said agitating means being operably connected to said wheel means and said enclosure means including a transparent region to make said cloud-like suspension visible from outside said enclosure means.

2. The toy of claim 1, said rotatable brush having an axle mounted for rotation and a plurality of plastic strips extending outwardly of said axle.

3. The toy of claim 1 wherein said particulate matter comprises comminuted plastic film particles.

4. The toy of claim 1 having means to collect the particles dispersed within said enclosure by said agitating means and to continuously return them to a location in the path of said agitating means.

5. The toy of claim 1 wherein said enclosure means is entirely transparent to enable the interior of said enclosure means to be viewed.

6. The toy of claim 1 wherein said housing is in the form and shape of a lawn mower.

7. The toy of claim 1 including vibrating means for imparting vibratory movements to the user.

8. The toy of claim 7, wherein said vibrating means includes depressions formed in the outer surface of said wheel means.

9. The toy of claim 8 wherein said wheel means includes two sets of wheels mounted on juxtaposed axles, rotatably secured to said housing, each of said wheels having axially extending depressions to generate vibration when said wheels are rotated.

10. The toy of claim 1 including a sounding means for providing an audible signal automatically responsive to movement of said toy.

11. The toy of claim 10 having an axle and a pair of wheels mounted on said axle connected to said housing, said sounding means including a sounding gear mounted on said axle for rotation and a vibratable reed mounted on said housing to engage said sounding gear as it rotates.

12. A toy power tool comprising:

a housing in the shape of a power tool;

wheel means mounted on said housing for rotation when said housing is pushed over a surface;

enclosure means extending away from said housing for holding particulate matter, said enclosure means having agitating means mounted within the interior thereof and a bed of particulate matter held within said enclosure means for agitation by said agitating means, said agitating means being operably connected to said wheel means, said agitating means further including a rotatable brush mounted adjacent one end of said enclosure means, the lower end of said enclosure means conforming to the path of movement of said agitating means so that said particles are contacted by said agitating means and dispersed within the interior of said enclosure means when said toy is pushed over a surface; and, a handle extending from said housing generally parallel to said enclosure means, said enclosure means including means for releasably attaching said enclosure means to said handle.

* * * * *